United States Patent [19]

Kubick

[11] 4,386,443

[45] Jun. 7, 1983

[54] FLOOR SQUEEGEE STRUCTURE

[75] Inventor: Matthew D. Kubick, Poland, N.Y.

[73] Assignee: Perfex Corporation, Herkimer, N.Y.

[21] Appl. No.: 234,605

[22] Filed: Feb. 17, 1981

[51] Int. Cl.[3] ..... A47L 1/08

[52] U.S. Cl. ..... 15/245; 15/250.36

[58] Field of Search ..... 15/121, 245, 250.36, 15/250.42

[56] References Cited

U.S. PATENT DOCUMENTS

| | | | |
|---|---|---|---|
| 395,267 | 12/1888 | Cooke | 15/245 |
| 1,497,933 | 6/1924 | Oberti | 15/245 |
| 2,193,571 | 3/1940 | Siemund | 15/245 X |
| 2,586,472 | 2/1952 | McKown | 15/245 X |
| 2,677,144 | 5/1954 | Parry | 15/245 X |
| 3,766,591 | 10/1973 | Soito | 15/245 |
| 4,075,730 | 2/1978 | Siemund | 15/245 |

*Primary Examiner*—Chris K. Moore

*Attorney, Agent, or Firm*—Berman, Aisenberg & Platt

[57] ABSTRACT

A floor squeegee is used to force water along a flat, planar floor surface for pooling the water for subsequent removal. The squeegee comprises a handle, a connector attached to the handle and a blade held by the connector. The blade of the squeegee has a first spine portion of relatively inflexible material and a second flexible blade portion connected to the first spine portion. The flexible blade portion contacts the surface from which water is to be removed. Both the connector and the two component blade are relatively unaffected by either weak or strong acid or alkali solutions.

8 Claims, 6 Drawing Figures

FLOOR SQUEEGEE STRUCTURE

TECHNICAL FIELD OF THE INVENTION

The invention relates to a squeegee used for removing water from a flat surface. The structure disclosed incorporates a new flexible squeegee blade that is substantially unaffected by commonly used chemical solutions, has a limited number of parts and will not mar the surfaces it contacts.

BACKGROUND ART

The background art shows a variety of squeegee structures as well as parts formed of extruded dual durometer plastic.

In U.S. Pat. No. 4,188,765 issued to Norman C. Jackson on Feb. 19, 1980, is disclosed a rubber edged sealing member made of polyvinyl chloride having a hard rubber sealing portion and a softer gripping portion with gripping fingers made of a material softer than polyvinyl chloride. The sealing strips disclosed in Jackson may be made in an extrusion process whereby a strip is extruded about a metal stiffening member with two different durometer hardnesses extruded into a single sealing piece.

U.S. Pat. No. 3,766,591 issued to Frank S. Soito on Oct. 23, 1973, discloses a structure for a squeegee having a tubular handle portion and a squeegee blade which is made of two components. The squeegee blade has a flexible floor contacting component made of rubber or neoprene, which has a uniform cross section across the squeegee width and a stiffening member disposed within the spine of the blade to provide stiffness to the blade. In this structure, the blade is generally flexible to conform to the floor surface being squeegeed and the stiffening rod in the spine of the squeegee blade creates a laterally stiff blade with which to move water.

In U.S. Pat. No. 4,232,081 issued to Roland E. Pullan on Nov. 4, 1980 is disclosed a sealing strip made of dual durometer plastic which has different hardnesses to form a weatherproof seal around a door. The sealing strip is an extruded portion having a U-shaped body extruded over a semirigid carrier. Simultaneously are extruded flexible gripper fins, made of softer material, which sealingly grip around the planar portion of a flange to which the sealing strip is applied. The main body of the sealing strip is made of hard polyvinyl chloride and soft polyvinyl chloride is used on the gripper fins which deform around the planar member to form a watertight stripping seal.

The prior art shows squeegee structures and sealing strips made of dual durometer polyvinyl chloride, but no squeegee structure is taught having a blade which is made of dual durometer material to form a stiff spine and a flexible blade for conforming to a floor surface for pushing water across the surface without additional components.

OBJECTS AND SUMMARY OF THE INVENTION

One object of the current invention is to produce a squeegee blade that has an integral, relatively stiff spine and a flexible blade to conform to the surface of the floor being squeegeed.

Another object of the current invention is to produce a squeegee blade that is not affected by relatively weak acid or alkali solutions, such as cleaning solutions, used in conjunction with it.

Another object of the current invention is to show a structure for a squeegee blade having a relatively stiff spine portion and a flexible blade portion which will not mar surfaces with which it comes in contact.

Another object of the current invention is to produce a squeegee with a blade that can be formed as a single piece without the need for a separate blade stiffening member to be added after the blade is formed.

Another object of the current invention is to provide a squeegee with a blade that pools water pushed by the blade in front of the blade.

It is another object of the current invention to produce a squeegee structure wherein the squeegee blade has a relatively stiff spine portion and a relatively flexible blade portion to conform to the floor surface and push water in front of it.

Another object of the current invention is to produce a squeegee blade connector that can be cast from a material that is substantially unaffected by weak acid or alkali solutions.

Another object is to produce a squeegee blade connector that allows a worn blade to be pushed out of the blade holder through an opening and a replacement blade slid into a blade accepting cavity and locked in place through the interaction of a locking button on the connector and a slot on the blade.

These and other objects of the current invention are achieved through the structure of a squeegee having a handle, a connector attached to one end of the handle and a squeegee blade held at an obtuse angle to the longitudinal axis of the handle. The blase has a first spine portion of relatively inflexible material extending the entire width of the blade and a second inflexible blade portion contacting the surface to be squeeged, the second portion being bonded to the first portion.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the specific embodiment, when read in connection with the accompanying drawings, wherein like reference characters indicate like parts throughout the several figures, and in which:

DETAILED DESCRIPTION OF THE CURRENT INVENTION

Figure 1:
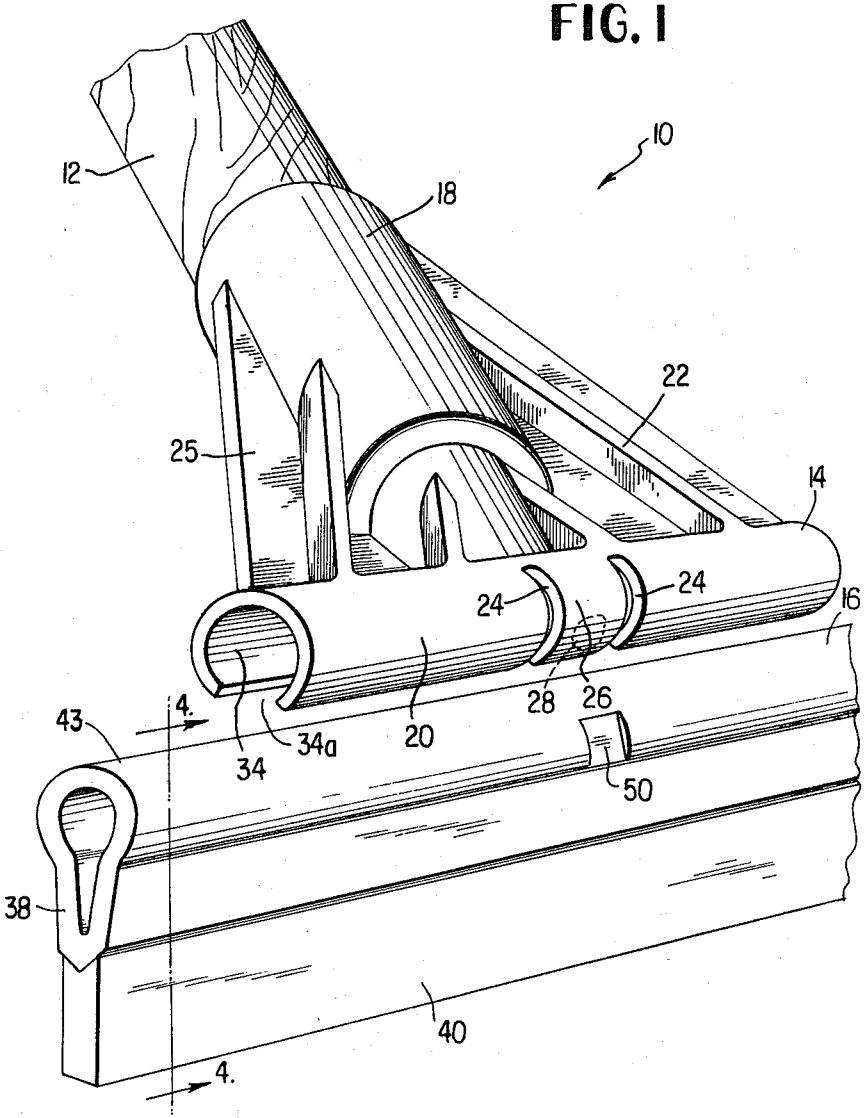
FIG. 1 is a partially exploded perspective view of the squeegee of the current invention, disassembled from the blade connector and handle.
Figure 6:
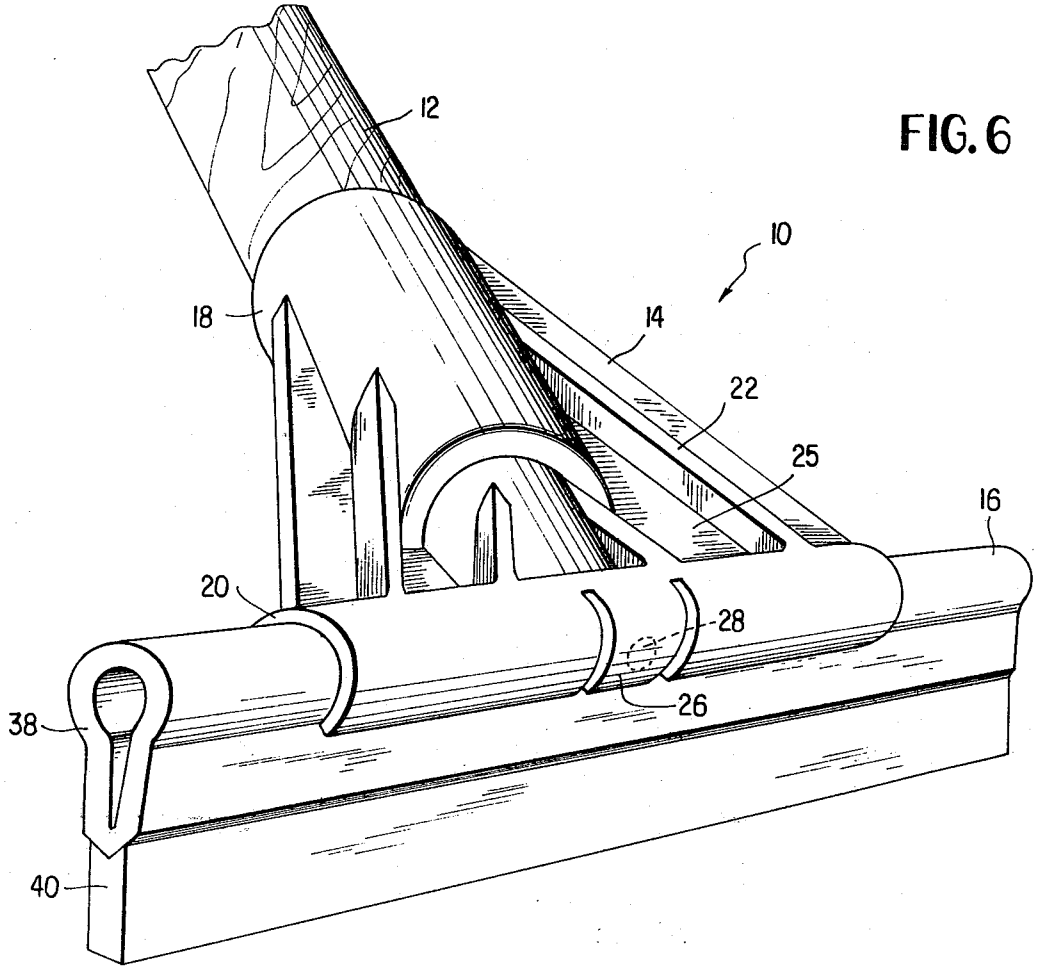
FIG. 6 is a perspective view of an assembled squeegee of the current invention.

Referring now more particularly to FIG. 1 and FIG. 6, the squeegee 10 of the current invention can be seen in a perspective view. The squeegee 10 comprises a handle 12, a blade connector 14 and a squeegee blade 16. The connector 14 functions to hold the squeegee blade 16 at an obtuse angle to the handle 12 to allow it to push water across a flat planar surface, such as a floor, to collect the water in front of the blade.

Figure 2:
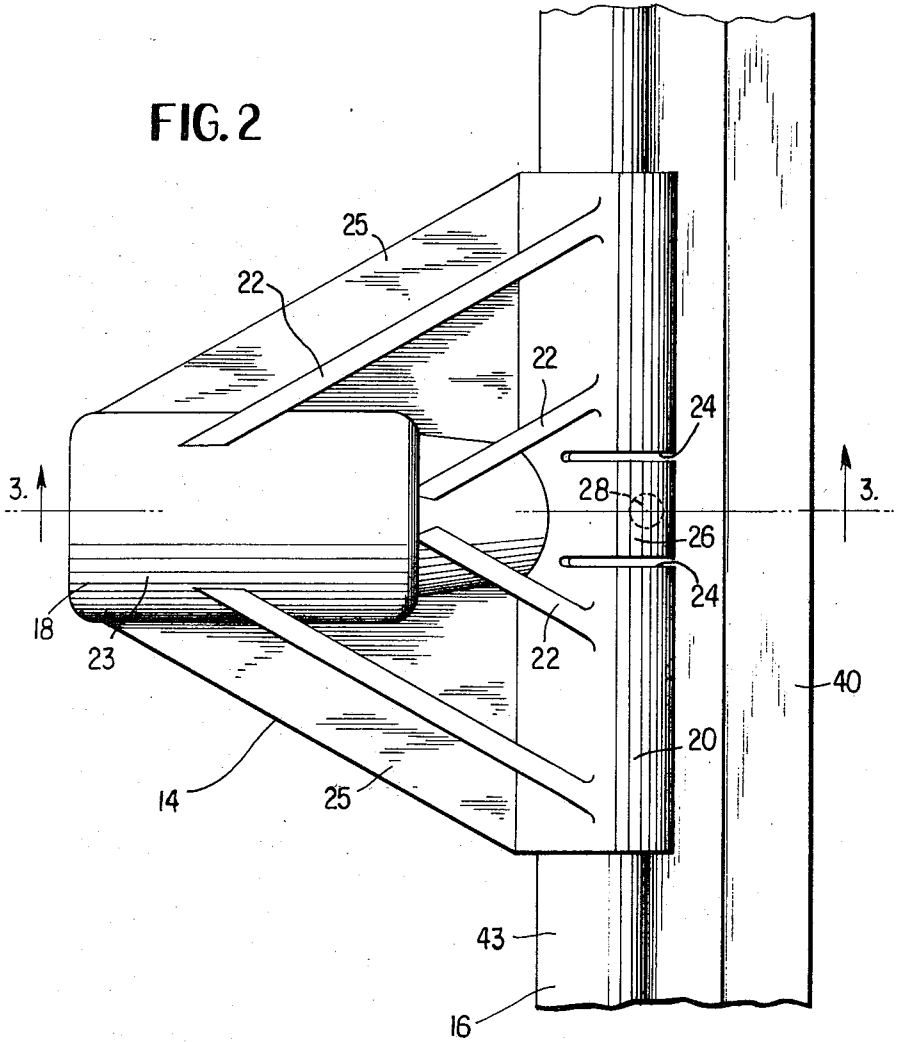
FIG. 2 is a plan view of the connector and the squeegee blade.

As seen in FIG. 2, the connector 14 has a handle sleeve 18 which accepts the lower end of the cylindrical handle 12 (not shown in FIG. 2). The handle sleeve 18 is a substantially annular connection for holding handle 12. A blade holder 20 is used to secure a blade 16 in place at an angle of approximately 135° to the longitudinal centerline of handle 12 so that the blade may contact the surface being squeegeed and push water along a line substantially perpendicular to the blade 16. Bracing struts 22 extend from the outer annular surface 23 of the handle sleeve 18 to the blade holder 20 and maintain the squeegee blade 16 in its desired position with respect to the longitudinal centerline of the handle. A web 25 extends between bracing struts 22 and blade holder 20 to connect the outer annular surface 23 of handle sleeve 18 to blade holder 20 and hold blade holder 20 in place. Blade holder 20 has transverse cuts 24 which define a locking flap 26. Locking flap 26 has a locking button 28 which is a cylindrical projection, seen in phantom lines in FIG. 2, which projects downwardly to lockingly engage blade 16.

The handle connector 14 is preferably made of rigid polyvinyl chloride, high impact polystyrene or other similar materials. When made of rigid polyvinyl chloride, the connector 14 has a hardness durometer measured on the Shure D scale of 65–80; a tensile strength of 6000–7500 psi; a flexural modulus of $300–500\times10^3$ psi at room temperature and is substantially unaffected by alkali or acid solutions. The connector 14 in the embodiment shown is formed by pouring liquid plastic material in a stainless steel mold to cast the formed connector 14. The cast connector 14 is made of a material that is not innately subject to corrosion. The structure is substantially nonporous and will not present voids to harbor bacteria.

Figure 3:
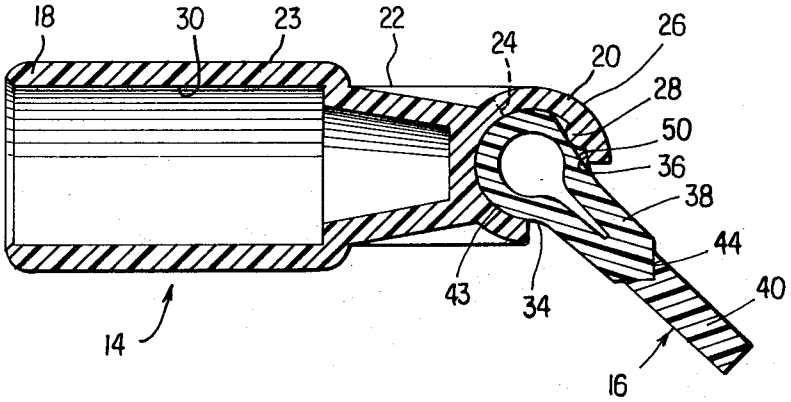
FIG. 3 is a side cross sectional view of the connector and blade.

The connector 14 can be seen in FIG. 3 in a side cross sectional view taken along line 3—3 of FIG. 2. Handle sleeve 18 is substantially annular in structure having an inner annular surface 30 and an outer annular surface 23. One end of the handle 12 is inserted and contained within the confines of inner annular surface 30. Bracing struts 22 extend from the handle sleeve outer annular surface 23 to the blade holder 20. In side cross sectional view, the blade holder 20 is a substantially C-shaped structure having a blade opening 34 being generally tubular to snugly accept blade spine 38 and has a lower slot **34*a* which allows the blade portion to extend downwardly for use. The opening 34 is circumferentially defined by blade holder inner surface 36. The opening 34, in its preferred embodiment, has an inner diameter of 0.72 inches to accept the blade spine 38 and a 0.5 inch opening 34*a* to allow the blade 16 to protrude from blade holder 20 at approximately 135° from the longitudinal centerline of handle 12. Locking button 28 projects radially inward from blade holder inner surface 36 to lockingly engage slot 50 in blade 16 to prevent the transverse movement of the blade 16 with respect to the longitudinal centerline of handle 12. The connector 14 has a blade holder opening 34*a* which defines an opening through which the blade 16 protrudes to make contact with the surface to be cleaned. Blade 16 has a slot 50 to accept locking button 28 which prevents transverse movement of the blade 16 within blade holder 20. The shape of slot 50 and opening 34 allows the blade limited rotation within the connector to provide for the blade 16** contacting the surface to be squeegeed whether the squeegee is pushed or pulled across the floor surface.

Figure 4:
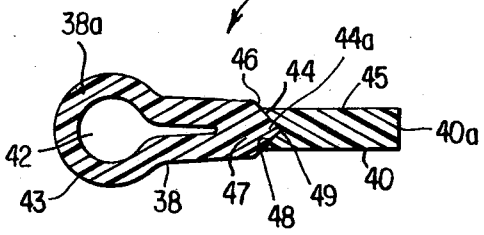
FIG. 4 is a side cross sectional view of the squeegee blade taken along lines 4—4 of FIG. 1.

A side cross sectional view of the squeegee blade 16 taken along section lines 4—4 of FIG. 1 can be seen in FIG. 4. As seen in FIG. 4, in its preferred form, the squeegee blade comprises a first blade spine portion 38 and a second blade flexible portion 40. The blade 16 is 2.155 inches from the top of the outer circumferentical surface **38*a* to the floor contacting edge of blade flexible portion 40. The spine portion has a substantially cylindrical outer circumferential surface 43 to be snugly held within the blade holder 20. Void 42 is centrally located in spine portion 38 extending throughout the width of the blade 16 to save material used to form the spine portion 38. Spine portion 38 and blade portion 40 are adjoined at blade portion interface 44. Interface 44 has an increased surface area greater than the distance between side surfaces 45 and is seen as a V in cross section having two interface surfaces 46 and 48. Surfaces 46 and 48 form oblique angles to the blade side surfaces 45. In the example shown, spine portion 38 extends 1.28 inches from outer circumferential surface 38*a* to the intersection of surface 46 and blade side surface 45. In a V-shaped interface, spine portion 38 extends 1.405 inches from outer circumferential surface 38*a* to the crotch 44*a* of the V interface 44. The blade flexible portion 40 extends preferably 0.875 inches from the intersection of surface 46 and side 45 to floor contacting edge 40*a*. By increasing the surface area of the interface, greater surface is provided for bonding between the two blade portions to provide a substantial connection between the spine 38 and the flexible portion 40. In the preferred form of interface, spine portion 38 has a V-shaped male interface surface 47 accepted in female interface surface 49 and blade components are secured by molecular bonds along interface surfaces 46 and 48. Although the interface is shown as a V in cross section in its preferred mode, any of a variety of shapes which increase the surface area of the interface may be used In a preferred mode, the blade spine portion 38** is preferably made of relatively rigid PVC material, i.e., "Geon" No. 8700A made by B. F. Goodrich, Inc. This preferred material has a specific gravity of 1.39, durometer hardness of $82\pm6$, but preferably $82\pm3$ on the Shure D scale; a compressive strength of 8100 psi; a flexural strength to deformation of 11,000 psi; a flexural modulus of 350,000 psi; tensile strength of 6,200 psi; a tensile modulus of 390,000 psi; and a basic corrosion resistance to weak acids or alkalis with some effect shown by strong acids or alkalis.

In the preferred mode, the flexible blade portion 40 is preferably comprised of a polyvinyl chloride material made by B. F. Goodrich & Co. called "Geon 8812". The flexible blade portion 40, in its preferred form, has a durometer of $65\mp6$, but preferably $65\pm3$ on the Shure A scale; a specific gravity of 1.24; tensile strength to deformation of 1400 psi; an ultimate elongation to destruction of 420%; a brittleness temperature of −30° F.; and a water absorption of 0.28% by weight. The blade portion 40 is substantially flexible and is too soft to measure flexural strength or flexural modulus. The blade has a substantial corrosion resistance to weak acid or alkali solutions, but is affected by strong solutions. The blade portion 40 is preferably made of a material that will conform to the surface being squeegeed to push water on the surface.

In its preferred form, the blade is made of two components coextruded through a single extrusion die to form a continuous length of squeegee blade. Once extruded, the blade can be cut into lengths as desired by an individual, but is conventionally cut into segments 18", 24", 30" and 36" long for final manufacture.

In an alternative embodiment, the blade spine portion and the blade flexible portion are formed separately and joined together by conventional means, as by cement.

Alternatively, the two separately formed blade portions can be interlocked through mechanical engagement to secure both portions of the blade together and prevent their coming apart.

Alternatively, a rigid spine portion is formed and passed through an extrusion head and the flexible blade portion is extruded onto the spine portion and bonded thereto during formation.

In its preferred mode, the spine portion 38 has a slot 50 centrally disposed which interacts with locking button 28 on locking flap 26 to hold blade 16 centrally mounted in connector 14.

Figure 5:
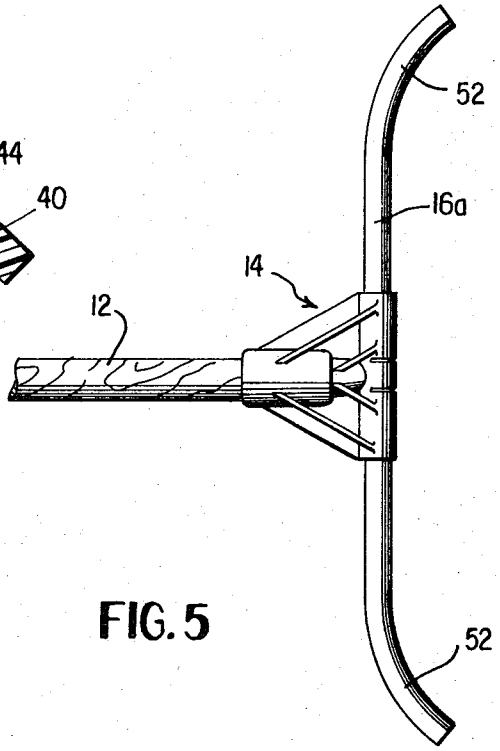
FIG. 5 is a plan view of an alternative embodiment of the squeegee blade of the present invention.

In an alternative embodiment, squeegee blade 16 is shown as having curved portions 52 on either end, as seen in FIG. 5, which pool water pushed by the squeegee to form a central pool in front of the squeegee. As the water is pooled toward the center of the blade 16, it may be more easily gathered for ultimate removal from the floor surface.

In use, squeegee 10 may be used for conventional squeegees on a wet floor surface. A worker may grasp handle 12 and push the squeegee, pushing water before blade 16 as it is deformed over the floor surface to conform thereto. Blade flexible portion 40 is of such a material to conform to the substantially planar surface to be cleaned to force any excess water resting on the surface forward of the pushed blade. Curved portions 52 pool the water in toward the central portion of the blade to contain the water before the blade and prevent its leaking outside the path of the squeegee 10. This allows water taken from the surface to be collected in a single place for removal. The spine portion 38 is rigid enough to keep the blade substantially at the desired angle to the longitudinal centerline of the handle.

As blade 16 is pushed against the floor surface, blade flexible portion 40 will, in time, be eroded away and need replacement. The squeegee blade 16 may be replaced by holding the squeegee 10 by the handle 12, and pressing the blade 16 to force the worn. A new blade is then aligned with the C-shaped opening 34 of the blade holder 20 and is slid parallel to the longitudinal axis of the blade holder 20 until slot 50 on the spine 38 of the blade 16 interacts with locking button 28. Interaction of locking button 28 and spine slot 50 holds the squeegee blade 16 symmetrically placed with respect to the longitudinal axis of handle 12. The squeegee is then ready for use and may be applied to a wet surface for squeegeeing. The symmetrical placement of the blade 16 in the connector 14 provides a balanced squeegee for use on a substantially flat planar surface.

Although a certain specific embodiment of the invention has been shown and described, it is obvious that many modifications thereof are possible. The invention, therefore, is not intended to be limited to the exact showing and description thereof, but is considered to include reasonable and obvious equivalents.

What is claimed is:

1. In a squeegee of the type having connector means for holding a blade, wherein the blade is held in an elongate cavity in the connector means, the improvement comprising:

first locking means resiliently attached to said connector means for cooperation with second locking means on said blade for preventing said blade from moving along said cavity in one position of said first locking means, and for allowing said blade to move along said cavity in another position of said first locking means.

2. The squeegee according to claim 1 wherein the improvement further comprises:

said cavity being cylindrical and forming an opening through which a part of said blade extends, said opening being wide enough to permit said blade to rotate in said cavity, to allow the blade to assume various orientations with respect to said connector, and wherein said second locking means comprises a notch in said blade for receiving said first locking means so that said locking means engages said notch for each of said various orientations.

3. The squeegee according to claim 2 wherein said first locking means is a flap of resilient material having the same curvature as said connector means and having a protrusion extending from said flap toward said elongate cavity.

4. The squeegee of claim 3 wherein said first locking means is of the same material as said connector.

5. The squeegee of claim 4 wherein said blade has a rigid spine and a flexible portion.

6. The squeegee of claim 5 wherein said spine portion has a hardness measured on the Shure D scale of $82 \pm 6$.

7. The squeegee of claim 6 wherein said flexible blade portion has a hardness measured on the Shure A scale of $65 \pm 6$.

8. The squeegee of claim 5 wherein said blade is U-shaped in a plane transverse to said flexible portion.

* * * * *